US011479981B2

(12) United States Patent
Hall et al.

(10) Patent No.: US 11,479,981 B2
(45) Date of Patent: Oct. 25, 2022

(54) SYSTEMS FOR RELEASABLY SECURING A PLATFORM

(71) Applicant: Hall Labs LLC, Provo, UT (US)

(72) Inventors: David R. Hall, Provo, UT (US); Benjamin Jensen, Orem, UT (US); Jonathan Marshall, Mapleton, UT (US)

(73) Assignee: Hall Labs LLC, Provo, UT (US)

( * ) Notice: Subject to any disclaimer, the term of this patent is extended or adjusted under 35 U.S.C. 154(b) by 804 days.

(21) Appl. No.: 16/424,656

(22) Filed: May 29, 2019

(65) Prior Publication Data

US 2020/0378139 A1 Dec. 3, 2020

(51) Int. Cl.

| | |
|---|---|
| ***E04G 7/26*** | (2006.01) |
| ***E04G 5/06*** | (2006.01) |
| ***E04H 3/26*** | (2006.01) |
| *E04G 5/00* | (2006.01) |

(52) U.S. Cl.

CPC ..... *E04G 7/26* (2013.01); *E04G 5/061* (2013.01); *E04H 3/26* (2013.01); *E04G 5/007* (2013.01)

(58) Field of Classification Search

CPC ..... A47C 1/126; A47C 17/00; E04G 5/007; E04G 5/061; E04G 7/26; E04H 3/26

See application file for complete search history.

(56) References Cited

U.S. PATENT DOCUMENTS

| | | | | | |
|---|---|---|---|---|---|
| 2,052,790 | A * | 9/1936 | Norton | A47C 17/84 | 5/9.1 |
| 3,399,887 | A * | 9/1968 | Altier | A63J 1/00 | 472/75 |
| 3,786,930 | A * | 1/1974 | Obregon | E04H 6/18 | 414/254 |
| 4,390,080 | A * | 6/1983 | Bushnell, Jr. | E06C 7/185 | 182/115 |
| 4,405,116 | A * | 9/1983 | Eisenberg | B66F 7/0608 | 187/269 |
| 4,563,121 | A * | 1/1986 | Drews | B60P 1/4421 | 414/545 |
| 4,575,975 | A * | 3/1986 | Eisenberg | B66F 7/0691 | 52/109 |
| 4,837,877 | A * | 6/1989 | Hamada | A47C 17/84 | 5/10.2 |
| 5,020,169 | A * | 6/1991 | Hamada | A47C 19/20 | 5/10.2 |
| 5,228,744 | A * | 7/1993 | Sugiyama | A47C 1/126 | 297/15 |
| 5,245,799 | A * | 9/1993 | Sugiyama | E04H 3/12 | 297/375 |

(Continued)

*Primary Examiner* — James M Ference

(57) ABSTRACT

A system for releasably securing a platform in a raised position is disclosed. A track is provided. An arm is connected at a first end to the platform. A second end, with a lug, is biased toward a side portion of the track. The lug is configured to ride in the track. As the platform is raised, the lug rides upward and enters the top portion and clears a first vertical wall, whereupon the lug rests in the depression and thus supports the platform in the raised position. As the platform is raised further, the lug clears a second vertical wall, whereupon the lug can ride downward in the side portion and through a bottom portion, past a door and out an open end of the bottom portion.

20 Claims, 5 Drawing Sheets

(56) References Cited

U.S. PATENT DOCUMENTS 5,319,895 A * 6/1994 Ray ..... E04H 3/26 52/126.5
5,468,190 A * 11/1995 McCaffrey ..... E04H 3/26 52/126.5
6,550,081 B2 * 4/2003 Vilsmeier ..... A47C 17/38 5/11
6,651,273 B2 * 11/2003 Vilsmeier ..... A47C 17/84 5/10.2
6,983,980 B2 * 1/2006 Rasmussen ..... A47C 17/84 296/156
7,562,496 B2 * 7/2009 Zwiebach ..... E04H 3/26 52/72
8,136,181 B2 * 3/2012 Roepke ..... A47C 17/84 5/10.1
8,979,025 B1 * 3/2015 Curry ..... B64D 9/00 244/118.1
9,380,881 B2 * 7/2016 Rasmussen ..... A47C 17/80
10,463,161 B2 * 11/2019 Johnson ..... A47C 19/22
2002/0046423 A1 * 4/2002 Vilsmeier ..... A47C 17/84 5/11
2002/0088052 A1 * 7/2002 Vilsmeier ..... A47C 17/84 5/136
2004/0262949 A1 * 12/2004 Rasmussen ..... F16M 13/02 296/61
2006/0070817 A1 * 4/2006 Campbell ..... E04G 1/22 187/238
2014/0159410 A1 * 6/2014 Rasmussen ..... B60P 3/39 296/24.33
2015/0184407 A1 * 7/2015 Kaiturinmaki ..... E04H 3/28 254/89 R
2018/0027978 A1 * 2/2018 Johnson ..... A47C 17/86
2018/0118539 A1 * 5/2018 Kritzer ..... B66F 7/28
2018/0258660 A1 * 9/2018 Altringer ..... E04H 3/26
2019/0084469 A1 * 3/2019 Rasmussen ..... B60P 3/39
2020/0378139 A1 * 12/2020 Hall ..... E04H 3/26

* cited by examiner

SYSTEMS FOR RELEASABLY SECURING A PLATFORM

TECHNICAL FIELD

The methods and processes described herein relate generally to securing loads.

BACKGROUND

Modifiable living spaces often contain stored furnishings below the floor. When the user desires to utilize these, the existing floor slides out of the way and the platform containing the furnishings is elevated, becoming the new floor. Releasably securing these platforms is often complex and expensive. Simple and cost effective systems for securing loads are required.

SUMMARY

In a first aspect, the disclosure provides a system for releasably securing a platform in a raised position. A track is provided, with a top portion having an open end, a bottom portion having an open end, and a side portion connecting the top portion and the bottom portion. An arm is connected at a first end to the platform. A second end is biased toward the side portion of the track. A lug is attached to the second end and configured to ride in the track, entering the open end of the top portion and exiting the open end of the bottom portion. A door is pivotally attached adjacent the bottom portion so as to allow the lug to exit the open end of the bottom portion and prevent the lug from entering the open end of the bottom portion. The top portion of the track has a depression in which the lug is supported when the platform is in the raised position, thereby supporting the platform in the raised position. The top portion of the track includes a first vertical wall separating the open end of the top portion and the depression and a second vertical wall separating the depression and the side portion. The second vertical wall extends to a higher point than the first vertical wall. The side portion has a downward sloping ramp, whereby the lug riding in the track is pushed toward the open end of the bottom portion when the platform is lowered. As the platform is raised, the lug rides upward and enters the top portion and clears the first vertical wall, whereupon the lug rests in the depression and thus supports the platform in the raised position. As the platform is raised further, the lug clears the second vertical wall, whereupon the lug can ride downward in the side portion and through the bottom portion, past the door and out the open end of the bottom portion.

In a second aspect, the disclosure provides a system configured to raise and lower a platform and to secure the platform in a raised position. A stationary frame and a platform are provided. A track is connected to one of the stationary frame and the platform. The track forms a closed loop, with a first side, a second side, a top portion, and a bottom portion. An arm is connected at a first end to the other of the stationary frame and the platform. A second end is biased toward the second side of the track. A lug is attached to the second end and configured to ride in the track. A door divides the bottom portion from the first side. The door pivots at one end to open and allow the lug to pass from the bottom portion to the first side. The door is biased to close so as to prevent the lug from passing from the first side to the bottom portion. The top portion of the track has a depression in which the lug is supported when the platform is in the raised position, thereby supporting the platform in the raised position. The top portion of the track includes a first vertical wall separating the first side and the depression and a second vertical wall separating the depression and the second side. The second generally vertical wall extends to a higher point than the first vertical wall. The side portion has a downward sloping ramp, whereby the lug riding in the track is pushed toward the first side when the platform is lowered. As the platform is raised, the lug rides upward in the first side until the lug clears the first vertical wall, whereupon the lug rests in the depression and thus supports the platform in the raised position. As the platform is raised further, the lug clears the second vertical wall, whereupon the lug can ride downward in the second side and through the bottom portion, past the door and into the first side.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
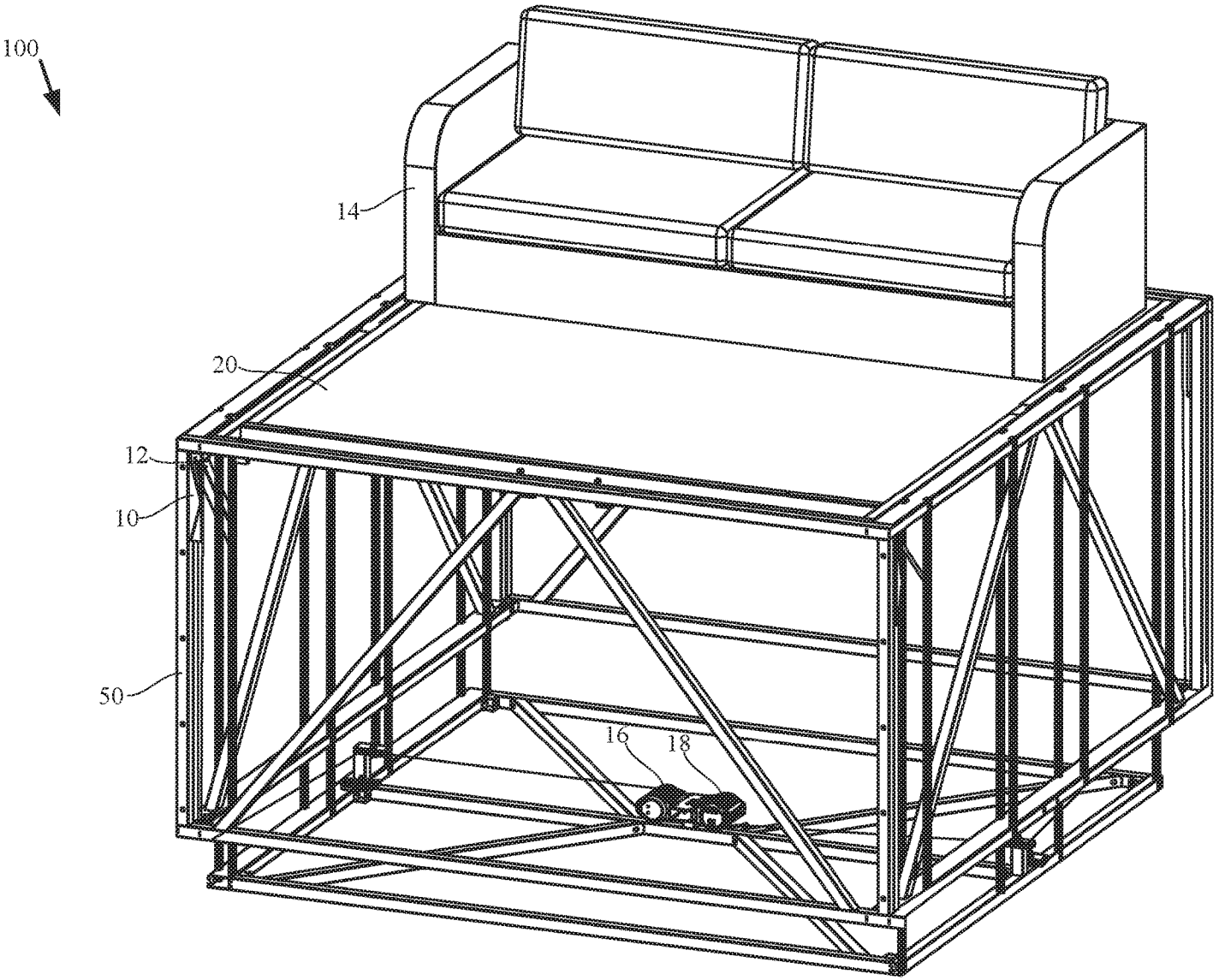
FIG. 1 is an isometric view of a platform with furnishings.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "vertical" means roughly parallel to the direction of travel of the platform. A slope of as much as 45 degrees would be considered vertical.

Modifiable office and living space allow a space to be used for multiple purposes. A room that is an office during the day may be converted to a living space in the evening. One method of doing this is to have furnishings stored in the floor. When the space transitions, the floor moves aside and a platform holding appropriate furnishings rises and becomes the new floor. When complete, the floor can be lowered back into storage. The present invention discloses systems for releasably securing a platform in this raised position. In a preferred embodiment, the platform is raised and lowered by a winch or winches. The four corners of the platform each have an arm attached at a first end. The second end of the arms are biased (by a spring, for example) towards a track that a lug on the second end of the arms follows. As the platform raises the lug tracks from a bottom portion of the track to a top portion of the track and above a first wall and enters an open end of the top portion. The top portion contains a depression in which the lug can then rest, holding the platform in place. Further elevation of the platform causes the lug to rise above a second wall at the back of the depression and enter a side portion of the track. The platform can then lower, the lug following the side portion until it passes through a one-way door and enters into the bottom portion of the track. The platform can then lower to its storage position below.

Now referring to FIG. 1, FIG. 1 is an isometric view of a platform with furnishings at 100 that may be used in the present invention to raise and lower a platform and secure the platform in a raised position. The platform 20 has furnishings 14 on it. The system includes a stationary frame 50, a platform 20, a track 10 at each corner, and an arm 12 at each corner. The system also includes a lug and a door, shown in FIGS. 3A-G and FIG. 4. The track is connected to the stationary frame and forms a closed loop, with a first side, a second side, a top portion, and a bottom portion. The track 10 is shown in detail in FIGS. 3A-G and FIG. 4 and is described below. The arms 12 are connected at a first end to the platform. A second end is biased toward the second side of the track. A lug is attached to the second end and is configured to ride in the track. Winches 16 and 18 raise and lower the platform 20. The motors of winches 16 and 18 are connected to a stationary member and drive the winch drums upon which a line is rolled and unrolled. The line is connected at one end to the drum and is connected at the other end to the platform.

Figure 2:
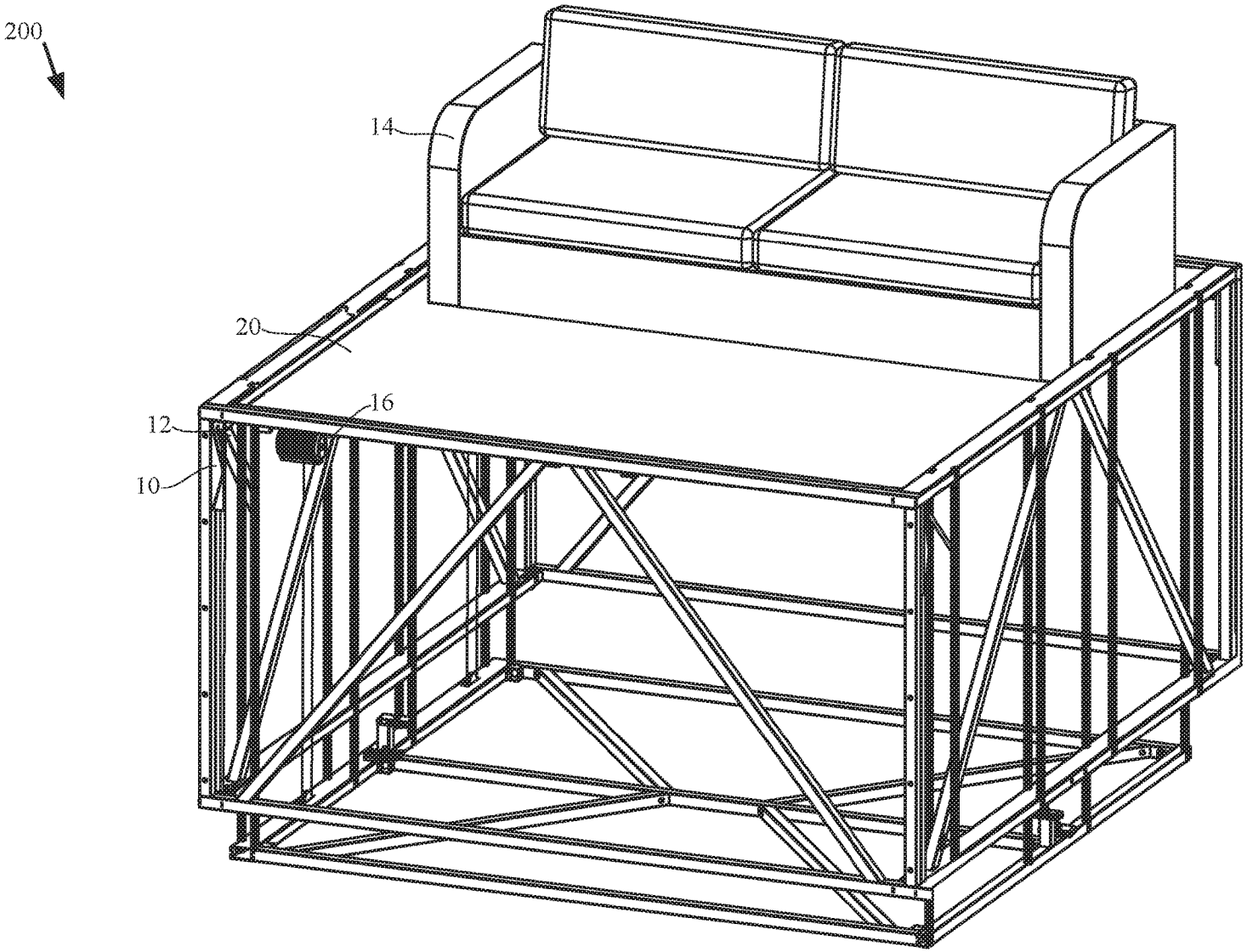
FIG. 2 is an isometric view of a platform with furnishings.

FIG. 2 is an isometric view of the platform 20 of FIG. 1, except with a winch 16 mounted under the platform 20 in one corner and a second winch (not shown) mounted under the platform 20 in an opposite corner. These winches raise and lower the platform 20. The motors of the winches are connected to the platform and drive the winch drums upon which a line is rolled and unrolled. The line is connected at one end to the drum and is connected at the other end to a stationary member.

Figures 3A, 3B, 3C, 3D, 3E, 3F, 3G:
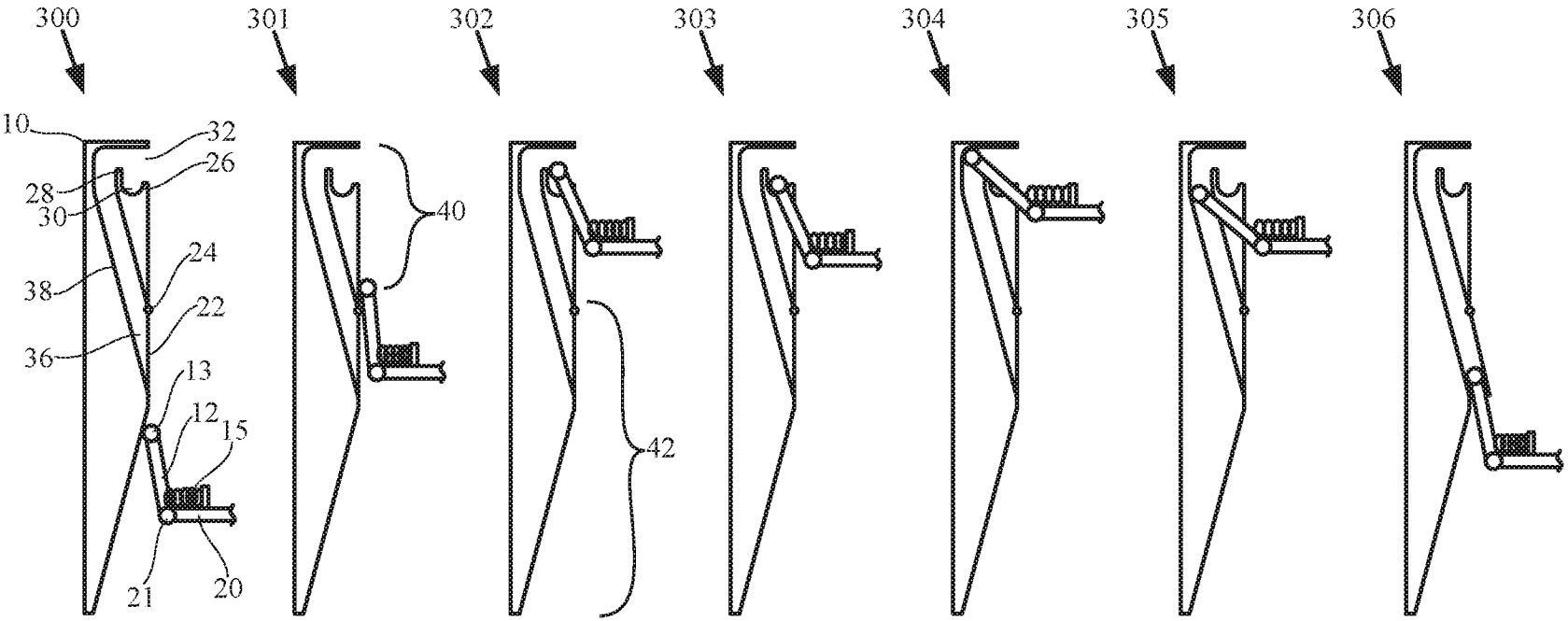
FIG. 3A is an elevation view of a track with a platform and an arm in a lowered position.
FIG. 3B is an elevation view of the track of FIG. 3A with the platform and the arm being raised.
FIG. 3C is an elevation view of the track of FIG. 3A with the platform and the arm moving into position over a depression.
FIG. 3D is an elevation view of the track of FIG. 3A with the platform and the arm secured in a raised position.
FIG. 3E is an elevation view of the track of FIG. 3A with the platform and the arm raising above a second vertical wall.
FIG. 3F is an elevation view of the track of FIG. 3A with the platform and the arm descending.
FIG. 3G is an elevation view of the track of FIG. 3A with the platform and the arm passing through a door.

FIG. 3A is an elevation view of a track with a platform and an arm in a lowered position at 300 that may be used in the present invention. FIG. 3B is an elevation view of the track of FIG. 3A with the platform and the arm being raised at 301. FIG. 3C is an elevation view of the track of FIG. 3A with the platform and the arm moving into position over a depression at 302. FIG. 3D is an elevation view of the track of FIG. 3A with the platform and the arm secured in a raised position at 303. FIG. 3E is an elevation view of the track of FIG. 3A with the platform and the arm raising above a second vertical wall at 304. FIG. 3F is an elevation view of the track of FIG. 3A with the platform and the arm descending at 305. FIG. 3G is an elevation view of the track of FIG. 3A with the platform and the arm passing through a door at 306.

The track 10 has a top portion 40, a bottom portion 42, and a side portion 38 connecting between the top portion 40 and the bottom portion 42. The top portion has an opening 32. The bottom portion has an opening 36. The opening 36 is blocked by a one-way door 22. The one-way door 22 only opens outward and spring hinge 24 closes the one-way door after a lug 13 passes through, preventing the lug 13 from entering the side portion 38 from the bottom portion 42. The arm 12 is connected to platform 20 by a hinge 21. The other end of the arm 12 has a lug 13. The arm 12 is biased towards the track 10 by a spring 15 that pushes the arm 12 towards the track 10. The lug 13 is configured to ride in the track 10, entering the opening 32 and exiting the opening 36.

The top portion of the track has a depression 30 between a first vertical wall 26 and a second vertical wall 28. The second vertical wall 28 is taller (extends to a higher point) than the first vertical wall 26. The second vertical wall 28 separates the depression 30 from the side portion 38. When the platform 20 is in the raised position the lug 13 rests in the depression 30, supporting the platform 20. In this manner, even if the winches or other lifting devices stop supporting the platform 20, the platform 20 is prevented from falling. The side portion 38 has a downward sloping ramp where the lug 13 riding in the side portion 38 is pushed toward the opening 36 and past the one-way door 22 into the bottom portion 42. The side portion 38 acts as a door stop preventing the one-way door 22 from pivoting past its closed position.

As the platform 20 is raised, the lug 13 rides upward through the bottom portion 42 (FIG. 3A), enters the top portion 40 (FIG. 3B), and clears the first vertical wall 26 (FIG. 3C). The lug 13 then settles into depression 30 (FIG. 3D), securing the platform 20. Releasing the platform 20 involves raising the platform 20 further such that the lug 13 clears the second vertical wall 28 and enters the side portion 38 (FIG. 3E). The platform 20 lowers with the lug 13 riding through the side portion 38 (FIG. 3F) and through opening 36 past door 22 (FIG. 3G) to return to the bottom portion 42 of the track 10 (FIG. 3A).

In some embodiments, the lug is cylindrical and rolls relative to the arm as the lug rides in the track. In other embodiments, the lug is stationary relative to the arm.

Figure 4:
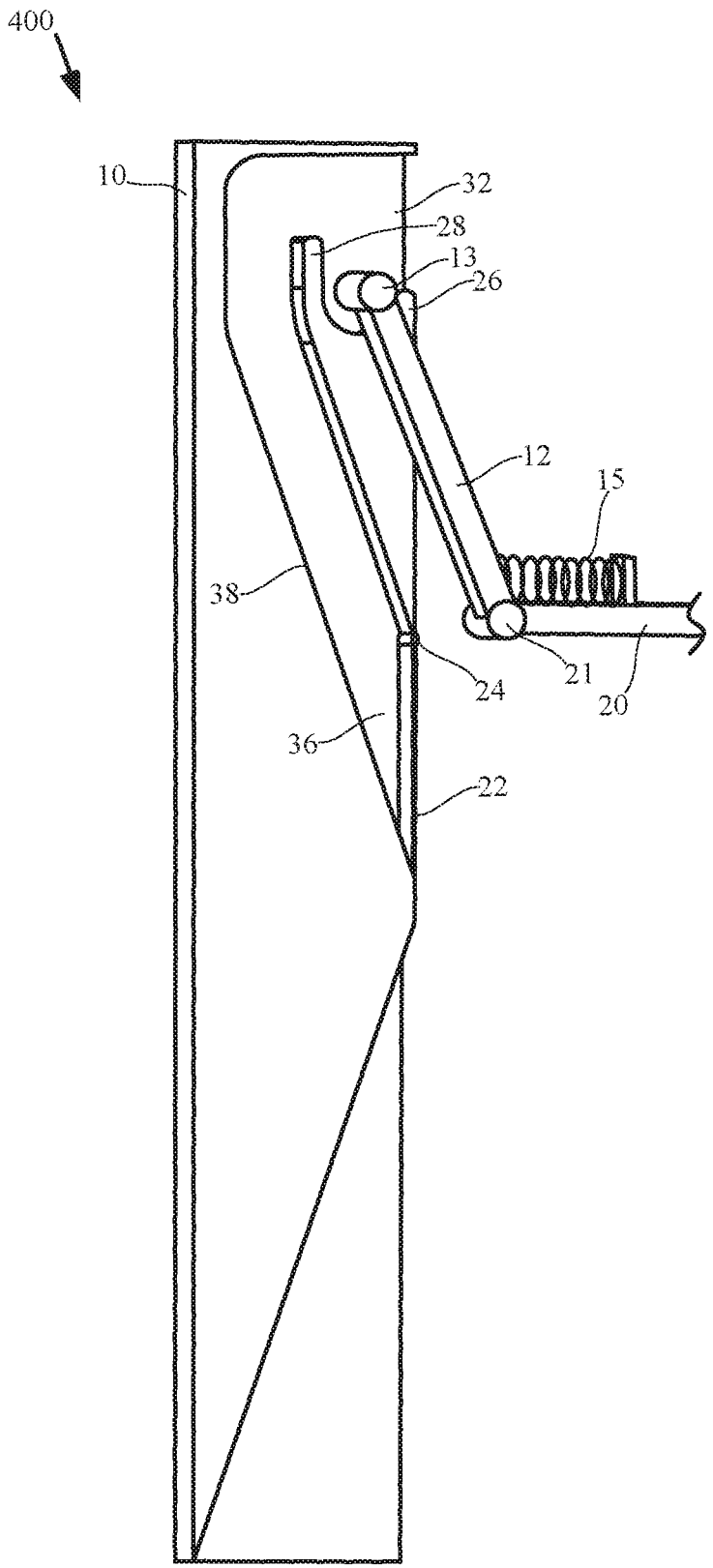
FIG. 4 is an isometric view of the track of FIGS. 3A-G.

FIG. 4 is an isometric view of the track of FIGS. 3A-G at 400, between FIGS. 3C and 3D.

Figure 5:
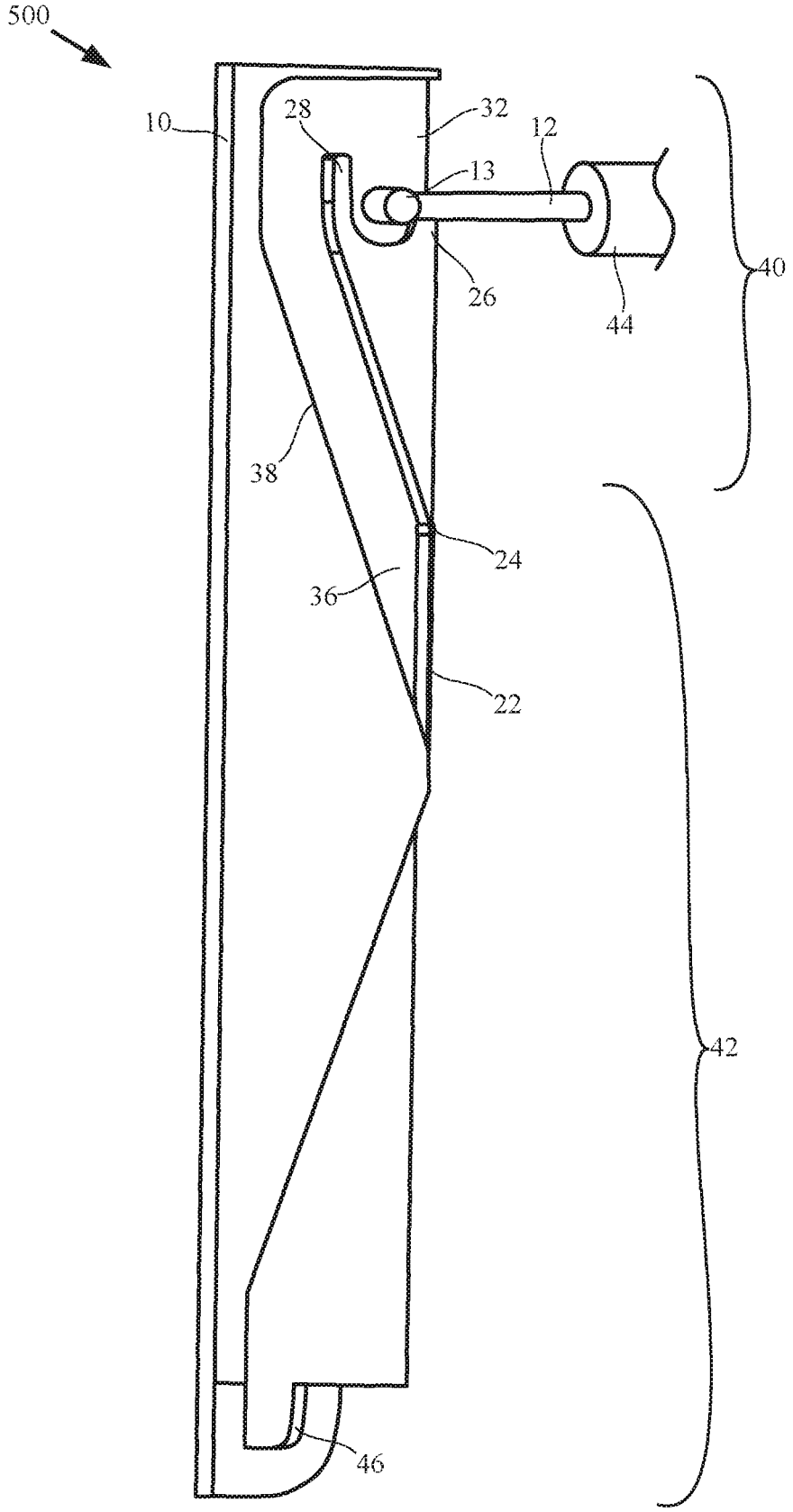
FIG. 5 is an isometric view of a track with a piston.

FIG. 5 is an isometric view of a track with a piston at 500 that may be used in one embodiment of the present invention. The track 10 has a top portion 40, a bottom portion 42, and a side portion 38 connecting between the top portion 40 and the bottom portion 42. The top portion has an opening 32. The bottom portion has an opening 36. The opening 36 is blocked by a one-way door 22. The one-way door 22 only opens outward and hinge 24 closes the one-way door by gravity (being biased by gravity to a closed position) after a lug 13 passes through, preventing the lug 13 from entering the side portion 38 from the bottom portion 42. The arm 12 is connected to the platform by a piston cylinder 44. The other end of the arm 12 has a lug 13. The arm 12 is biased towards the track 10 by the piston cylinder 44 pushing the arm 12 towards the track 10. The lug 13 is configured to ride in the track 10, entering the opening 32 and exiting the opening 36.

The top portion of the track has a depression 30 between a first vertical wall 26 and a second vertical wall 28. The second vertical wall 28 is taller (extends to a higher point) than the first vertical wall 26. The second vertical wall 28 separates the depression 30 from the side portion 38. When the platform is in the raised position the lug 13 rests in the depression 30, supporting the platform. In this manner, even if the winches or other lifting devices stop supporting the platform, the platform is prevented from falling. The side portion 38 has a downward sloping ramp where the lug 13 riding in the side portion 38 is pushed toward the opening 36 and past the one-way door 22 into the bottom portion 42.

As the platform is raised, the lug 13 rides upward through the bottom portion 42, enters the top portion 40, and clears the first vertical wall 26. The lug 13 then settles into depression 30, securing the platform. Releasing the platform involves raising the platform further such that the lug 13 clears the second vertical wall 28 and enters the side portion 38. The platform lowers with the lug 13 riding through the side portion 38 and through opening 36 past door 22 to return to the bottom portion 42 of the track 10. In this embodiment, at the bottom of the bottom portion 42 a second depression 46 allows the lug 13 to rest the platform securely in a fully lowered position.

In a preferred embodiment, the lug has a diameter between 0.5 and 2 times the height of the vertical wall. In a more preferred embodiment, the lug has a diameter between 0.25 and 1 times the height of the second vertical wall.

In some embodiments, the platform has home furnishings. In other embodiments, the platform has office furnishings.

The invention has been described with reference to various specific and preferred embodiments and techniques. Nevertheless, it is understood that many variations and modifications may be made while remaining within the spirit and scope of the invention.

What is claimed is:

1. A system for releasably securing a platform in a raised position comprising:

a track, with a top portion having an open end, a bottom portion having an open end, and a side portion connecting the top portion and the bottom portion;

an arm connected at a first end to the platform, and wherein a second end is biased toward the side portion of the track;

a lug attached to the second end and configured to ride in the track, entering the open end of the top portion and exiting the open end of the bottom portion;

a door pivotally attached adjacent the bottom portion so as to allow the lug to exit the open end of the bottom portion and prevent the lug from entering the open end of the bottom portion;

wherein the top portion of the track comprises a depression in which the lug is supported when the platform is in the raised position, thereby supporting the platform in the raised position, and wherein the top portion of the track includes a first vertical wall separating the open end of the top portion and the depression and a second vertical wall separating the depression and the side portion, and wherein the second vertical wall extends to a higher point than the first vertical wall; and wherein the side portion comprises a downward sloping ramp, whereby the lug riding in the track is pushed toward the open end of the bottom portion when the platform is lowered;

whereby, as the platform is raised, the lug rides upward and enters the top portion and clears the first vertical wall, whereupon the lug rests in the depression and thus supports the platform in the raised position; and whereby as the platform is raised further, the lug clears the second vertical wall, whereupon the lug can ride downward in the side portion and through the bottom portion, past the door and out the open end of the bottom portion.

2. The system of claim 1, wherein the lug is cylindrical and rolls relative to the arm as the lug rides in the track.

3. The system of claim 1, wherein the lug is stationary relative to the arm.

4. The system of claim 1, wherein the first end of the arm is pivotably attached to the platform and the second end of the arm is biased toward the side portion of the track by a spring.

5. The system of claim 1, wherein the first end of the arm is a shaft of a piston and the second end of the arm is biased toward the side portion of the track by a force applied by the piston.

6. The system of claim 1 wherein the door is pivotally attached at an upper end, wherein the track comprises a door stop preventing a bottom end of the door from pivoting past a closed position and wherein gravity biases the door to a closed position.

7. The system of claim 6 wherein the door is also biased to the closed position by a door spring.

8. The system of claim 1 wherein the lug has a diameter which is between 0.5 and 2 times the height of the first vertical wall.

9. The system of claim 1 wherein the lug has a diameter which is between 0.25 and 1 times the height of the second vertical wall.

10. The system of claim 1 further comprising a lug stop, upon which the lug rests when the platform is in a lowered position.

11. The system of claim 1, wherein the platform supports home furnishings or office furnishings.

12. The system of claim 1, wherein the platform is raised and lowered by a motor.

13. The system of claim 12, wherein the motor is connected to a stationary member and drives a drum upon which a line is rolled and unrolled, which line is connected at one end to the drum and is connected at another end to the platform.

14. The system of claim 12, wherein the motor is connected to the platform and drives a drum upon which a line is rolled and unrolled, which line is connected at one end to the drum and is connected at another end to a stationary member.

15. A system configured to raise and lower a platform and to secure the platform in a raised position, comprising:

a stationary frame;

a platform;

a track connected to the stationary frame, with a top portion having an open end, and a bottom portion having an open end, and a side portion connecting the top portion and the bottom portion;

an arm connected at a first end to the platform, and wherein a second end is biased toward the second side of the track;

a lug attached to the second end and configured to ride in the track, entering the open end of the top portion and exiting the open end of the bottom portion;

a door pivotally attached adjacent the bottom portion so as to allow the lug to exit the open end of the bottom portion and prevent the lug from entering the open end of the bottom portion;

wherein the top portion of the track comprises a depression in which the lug is supported when the platform is in the raised position, thereby supporting the platform in the raised position, and wherein the top portion of the track includes a first vertical wall separating the open end of the top portion and the depression and a second vertical wall separating the depression and the side portion, and wherein the second vertical wall extends to a higher point than the first vertical wall; and wherein the side portion comprises a downward sloping ramp, whereby the lug riding in the track is pushed toward the open end of the bottom portion when the platform is lowered;

whereby, as the platform is raised, the lug rides upward and enters the top portion and clears the first vertical wall, whereupon the lug rests in the depression and thus supports the platform in the raised position; and whereby as the platform is raised further, the lug clears the second vertical wall, whereupon the lug can ride downward in the side portion, past the door and out the open end of the bottom portion.

16. The system of claim 15, wherein the first end of the arm is pivotably attached to the platform and the second end of the arm is biased toward the side portion of the track by a spring.

17. The system of claim 15, wherein the first end of the arm is a shaft of a piston and the second end of the arm is biased toward the side portion of the track by a force applied by the piston.

18. The system of claim 15 wherein the door is pivotally attached at an upper end of the door, wherein the track comprises a door stop preventing a bottom end of the door from pivoting past a closed position and wherein gravity biases the door to the closed position.

19. The system of claim 18 wherein the door is also biased to the closed position by a door spring.

20. A system for securing a platform at four corners comprising four of the systems defined by claim 1 operating at each of the four corners.

* * * * *